US007963811B2

(12) United States Patent
Wason et al.

(10) Patent No.: US 7,963,811 B2
(45) Date of Patent: Jun. 21, 2011

(54) ELECTRICAL GROUND CONNECTOR

(75) Inventors: Peter M. Wason, Manchester, NH (US); Peter Therrien, Bedford, NH (US)

(73) Assignee: Hubbell Incorporated, Shelton, CT (US)

( * ) Notice: Subject to any disclaimer, the term of this patent is extended or adjusted under 35 U.S.C. 154(b) by 188 days.

(21) Appl. No.: 12/378,432

(22) Filed: Feb. 12, 2009

(65) Prior Publication Data

US 2010/0203748 A1 Aug. 12, 2010

(51) Int. Cl.
*H01R 13/648* (2006.01)

(52) U.S. Cl. ..... 439/798; 361/637; 439/778; 439/908

(58) Field of Classification Search ..... 439/798, 439/796, 797, 780, 777, 778, 908; 174/152 R, 174/78, 151, 59; 361/624, 637, 648, 669
See application file for complete search history.

(56) References Cited

U.S. PATENT DOCUMENTS

| | | | | | |
|---|---|---|---|---|---|
| 2,281,515 | A | * | 4/1942 | Ruggieri | 174/59 |
| 2,511,995 | A | * | 6/1950 | Robertson et al. | 439/724 |
| 2,643,363 | A | * | 6/1953 | Robertson et al. | 439/724 |
| 2,697,818 | A | * | 12/1954 | Morgan | 439/712 |
| 2,909,757 | A | | 10/1959 | Speck | 339/198 |
| 2,997,530 | A | * | 8/1961 | Rosan | 174/153 R |
| 3,125,398 | A | | 3/1964 | Wolf | 339/272 |
| 3,323,097 | A | * | 5/1967 | Tordoff | 439/370 |
| 3,414,868 | A | * | 12/1968 | Howe | 439/521 |
| 3,541,231 | A | * | 11/1970 | Keto | 174/152 R |
| 3,546,364 | A | | 12/1970 | O'Neel | 339/242 |
| 3,594,710 | A | | 7/1971 | Stanback | 339/198 |
| 3,696,321 | A | * | 10/1972 | Cooper, Jr. | 439/566 |
| 3,794,963 | A | | 2/1974 | Cooper, Jr. | 339/242 |
| 3,832,604 | A | * | 8/1974 | Goodridge | 361/644 |
| 4,059,329 | A | * | 11/1977 | Macemon | 439/559 |
| 4,382,651 | A | | 5/1983 | Klosin et al. | 339/92 R |
| 4,405,196 | A | * | 9/1983 | Fulton | 439/551 |
| 4,547,627 | A | | 10/1985 | McGrane | 174/138 F |
| 4,785,378 | A | | 11/1988 | Hinckley et al. | 361/363 |
| 4,868,981 | A | * | 9/1989 | Hinckley et al. | 29/857 |
| 4,952,898 | A | * | 8/1990 | Nelson et al. | 336/65 |
| 5,197,903 | A | * | 3/1993 | Casey et al. | 439/564 |
| 5,342,998 | A | * | 8/1994 | Nolte et al. | 174/152 R |
| 5,690,516 | A | | 11/1997 | Fillinger | 439/798 |
| 5,835,341 | A | * | 11/1998 | Rhodes et al. | 361/637 |
| 5,920,456 | A | * | 7/1999 | Bozzone et al. | 361/627 |
| 5,931,708 | A | | 8/1999 | Annas et al. | 439/798 |
| 6,361,375 | B1 | | 3/2002 | Sinclair | 439/723 |
| 6,579,131 | B1 | | 6/2003 | Ashcraft et al. | 439/798 |

(Continued)

OTHER PUBLICATIONS

Burndy Products catalog, pp. A-3:A-5, FCI, 2000.

*Primary Examiner* — Neil Abrams
(74) *Attorney, Agent, or Firm* — Harrington & Smith

(57) ABSTRACT

An electrical ground connector assembly including a bus bar adapted to have a plurality of electrical wires separately connected thereto; and a combined electrical connection and mounting post assembly directly connected to the bus bar. The combined electrical connection and mounting post assembly is adapted to directly connect an electrical conductor thereto. The combined electrical connection and mounting post assembly extends from the bus bar in a generally cantilever fashion and is configured to supportingly attach the bus bar to a structure. A portion of the combined electrical connection and mounting post assembly could be mounted to extend through a hole in the structure, or alternatively a portion of the combined electrical connection and mounting post assembly could be mounted to an exterior side of the structure.

27 Claims, 11 Drawing Sheets

U.S. PATENT DOCUMENTS 6,664,469 B1 * 12/2003 Sweeney ..... 174/51
6,794,576 B1 * 9/2004 Justason et al. ..... 174/72 B
7,056,163 B2 * 6/2006 Hay ..... 439/810
7,075,021 B2 * 7/2006 Rowe et al. ..... 200/50.21
7,405,923 B2 * 7/2008 Kelly et al. ..... 361/644
7,508,653 B2 * 3/2009 Parlee ..... 361/652
7,537,467 B1 * 5/2009 Gretz ..... 439/108
7,637,754 B1 * 12/2009 Yerena et al. ..... 439/108
7,812,720 B2 * 10/2010 King et al. ..... 340/539.31

* cited by examiner

ELECTRICAL GROUND CONNECTOR

BACKGROUND OF THE INVENTION

1. Field of the Invention

The invention relates to an electrical connector and, more particularly, to an electrical connector which is attached to a structure or member.

2. Brief Description of Prior Developments

In residential housing, grounding of electrical service equipment, such as an electrical meter socket enclosure and an electrical equipment enclosure (such as a circuit breaker box), is provided. Intersystem bonding termination can be provided for services such as telephone, television, security systems, and network-powered broadband communications systems (NPBCS) cable for example. In the United States of America, a new article of the National Electric Code (NEC), Article 250.94, provides a standard regarding intersystem bonding termination. The termination needs to be accessible for connection and inspection, have the capacity for not less than 3 conductors, and shall not interfere with opening a service or metering equipment enclosure. Eritech, Ilsco and Greaves sell different types of intersystem bonding termination connectors.

There is a desire to provide a new type of intersystem bonding termination connector which can be connected to either electrical service equipment, such as an electrical meter socket enclosure and an electrical equipment enclosure (such as a circuit breaker box), or another structure, such as the exterior side of a house for example. There is also a desire to provide a new type of intersystem bonding termination connector which can be reconfigured to be used in different locations or applications.

SUMMARY

The following summary is merely intended to be exemplary. The summary is not intended to limit the scope of the claimed invention.

In accordance with one aspect of the invention, an electrical ground connector assembly is provided including a bus bar adapted to have a plurality of electrical wires separately connected thereto; and a combined electrical connection and mounting post assembly directly connected to the bus bar. The combined electrical connection and mounting post assembly is adapted to directly connect an electrical conductor thereto. The combined electrical connection and mounting post assembly extends from the bus bar in a generally cantilever fashion and is configured to supportingly attach the bus bar to a structure.

In accordance with another aspect of the invention, an electrical ground connector assembly is provided comprising an electrical connection section and a connecting system. The electrical connection section comprises a bus bar adapted to have a plurality of electrical wires separately connected thereto; and a post connector directly connected to the bus bar. The post connector is adapted to physically support the bus bar on a structure. The bus bar and post connector are adapted to be reconfigured relative to each other into at least two different configurations of the electrical ground connector assembly. The connecting system is for connecting the electrical ground connector assembly to at least two different types of structures. In a first one of the configurations a portion of the post connector is adapted to extend through a hole in a first one of the structures. In a second one of the configurations the post connector and the bus bar are configured to be substantially entirely located outside a second one of the structures at an exterior side of the second structure.

In accordance with another aspect of the invention, an electrical ground connector assembly is provided comprising an electrical connection section and a connecting system. The electrical connection section comprises a bus bar adapted to have a plurality of electrical wires separately connected thereto; and a combined electrical connection and mounting post directly connected to the bus bar. The combined electrical connection and mounting post is adapted to directly connect an electrical conductor thereto. The combined electrical connection and mounting post is adapted to physically support the bus bar on a structure. The connecting system is for connecting the electrical ground connector assembly to at least two different types of structures. The combined electrical connection and mounting post is adapted to connect to the electrical conductor inside the structure with the bus bar located outside the structure. The combined electrical connection and mounting post is adapted to alternatively connect to the electrical conductor outside the structure with the bus bar located outside the structure.

In accordance with another aspect of the invention, a method is provided comprising connecting a post connector directly to a bus bar in a first configuration, wherein the bus bar adapted to have a plurality of electrical wires separately connected thereto, wherein the post connector is directly connected to the bus bar, and wherein the post connector is adapted to physically support the bus bar on a first structure in a general cantilevered fashion; alternatively connecting the post connector directly to the bus bar in a second different configuration, wherein the post connector is adapted to physically support the bus bar on a second different structure in a general cantilevered fashion.

In accordance with another aspect of the invention, a method is provided comprising providing an electrical bus bar comprising a middle section with a post hole, and wire receiving areas on opposite sides of the post hole; connecting a mounting post to the bus bar by a connection comprising inserting the mounting post into the post hole through a first side of the bus bar to attach the bus bar to the mounting post in a first configuration; and providing the connection as an alternative connection wherein the mounting post can be inserted into the post hole through a second opposite side of the bus bar to attach the bus bar to the mounting post in a second different configuration, wherein the mounting post is adapted to attach the bus bar on a structure in either the first configuration or the second configuration.

In accordance with another aspect of the invention, an apparatus is provided comprising an enclosure forming a socket configured to have an electrical meter connected thereto; and an electrical ground connector assembly mounted to the enclosure. The electrical ground connector assembly comprises a bus bar adapted to have a plurality of electrical wires separately connected thereto; and a combined electrical connection and mounting post assembly directly connected to the bus bar. The combined electrical connection and mounting post assembly is adapted to directly connect an electrical conductor thereto. The combined electrical connection and mounting post assembly comprises a connection section located inside the enclosure which is adapted to have the electrical conductor directly attach thereto inside the enclosure. The bus bar is located outside of the enclosure.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENTS

Figure 1:
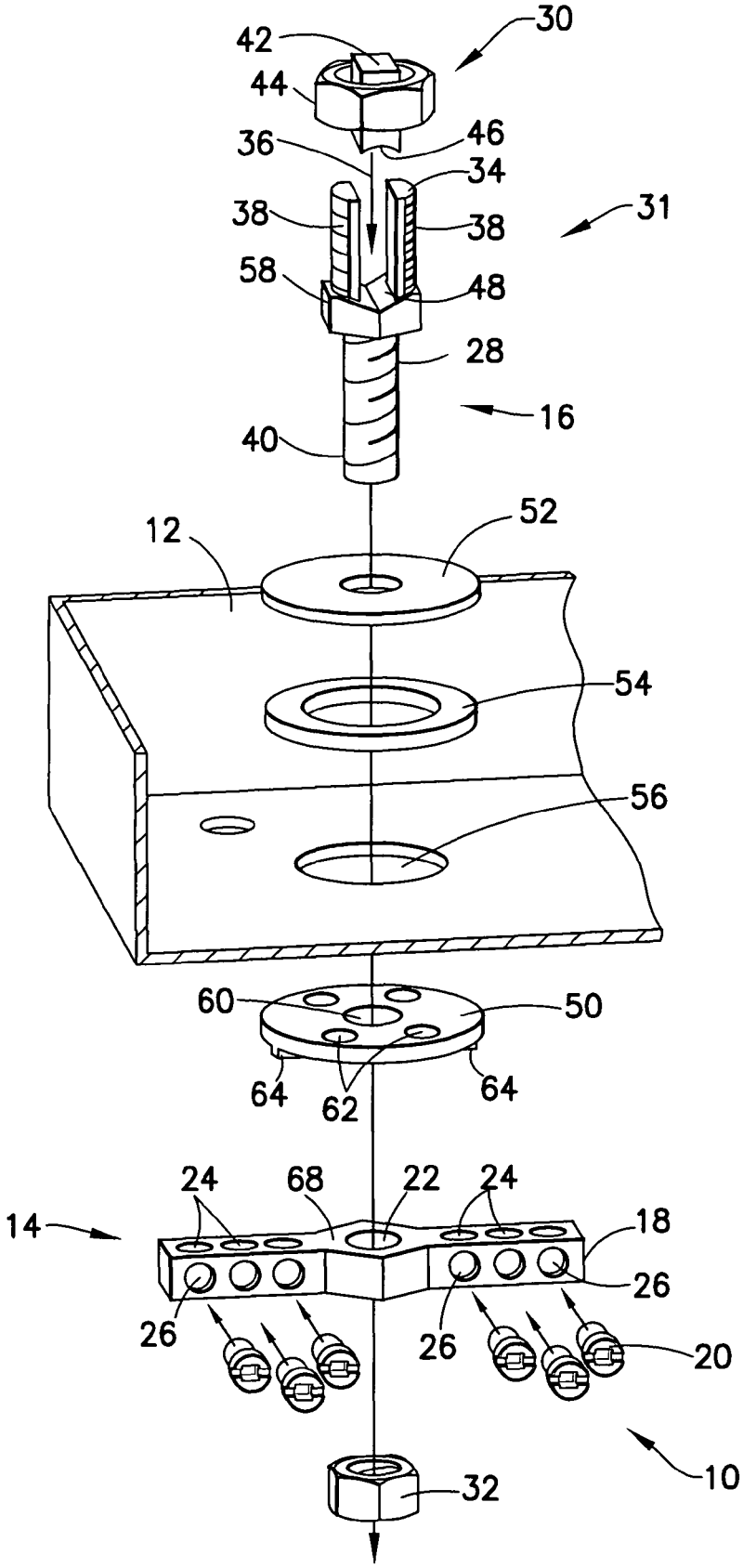
FIG. 1 is an exploded perspective view of a connector assembly incorporating features of the invention in a first configuration for attachment to a first structure.

Referring to FIG. 1, there is shown an exploded perspective view of an electrical connector assembly 10 incorporating features of the invention and a structure 12 which the connector is attached to. Although the invention will be described with reference to the example embodiments shown in the drawings, it should be understood that the invention can be embodied in many alternate forms of embodiments. In addition, any suitable size, shape or type of elements or materials could be used.

The connector assembly 10, in this embodiment, is an electrical ground connector. The connector assembly 10 can be used to provide intersystem bonding termination such as for telephone, television, security systems, and network-powered broadband communications systems (NPBCS) cable at residences for example. In a preferred embodiment the connector assembly 10 fulfills the standard of Article 250.94 of the U.S. National Electric Code (NEC). Thus, in this example embodiment the structure 12 could be a metal housing member of an electrical meter socket enclosure located on the exterior side of a residence, or an electrical equipment enclosure (such as a circuit breaker box) for example.

The connector assembly 10 generally comprises a bus bar 14 and a combined electrical connection and mounting post assembly 16. The bus bar 14 comprises a frame 18 and set screws 20. The frame 18 is a one-piece member comprised of electrically conductive metal. However, the frame 18 could comprise more than one member. The frame 18 comprises a middle with an aperture 22 and wire receiving holes 24 on opposite sides of the aperture 22. Threaded screw holes 26 intersect with the wire receiving holes 24. The set screws 20 are screwed into the threaded screw holes 26. The set screws 20 can clamp electrical wires or intersystem bonding conductors 4 (see FIG. 2), introduced into the holes 24, against the frame 18. This can mechanically and electrically connected the wires to the frame 18 and each other.

The combined electrical connection and mounting post assembly 16 generally comprises a post member or post connector 28, a pressure assembly 30, and a fastener 32. The post connector 28 comprises a one-piece member made of electrically conductive material, such as metal. However, the post connector 28 could comprise more than one member. A first end 34 of the post connector 28 has a slot 36 and arms 38. The arms 38 are located on opposite sides of the slot 36 and have exterior sides with screw threads. The slot 36 is sized and shaped to receive a portion of an electrical conductor 2 (see FIG. 3) between the arms 38.

A second end 40 of the post connector 28 is sized and shaped to connect to the fastener 32. In this embodiment the second end 40 has threads and the fastener 32 is a threaded nut. Thus, the nut 32 can be screwed onto the second end 40. However, in an alternate embodiment any suitable type of connection of the fastener 32 to the post connector 28 could be provided. A middle section 58 of the post connector 28 has a hexagon outer perimeter shape to facilitate holding the post connector 28 stationary when the fastener 32 is attached and when the pressure assembly 30 is attached. However, any suitable shape could be provided.

The pressure assembly 30 generally comprises a pressure bar 42 and a fastener 44. The fastener 44 has a general threaded nut shape and is sized and shaped to screw onto the arms 38 of the post connector 28. The pressure bar 42 is rotatably connected to the fastener 40 inside the center aperture of the fastener. The pressure bar 42 is sized and shaped to longitudinally slide in the slot 36 as the fastener 44 screws onto the arms 38. A bottom end 46 of the pressure bar 42 is configured to press the conductor 2 against the clamping surface 48 of the post connector 28 to mechanically and electrically connect the conductor to the first end 34.

The first end 34 and the pressure assembly 30 form a connection section 31 for connecting the electrical conductor to the assembly 16. However, in alternate embodiments, a different structure or configuration could be provided for this purpose. In an alternate embodiment, the slot 38, arms 38 and pressure assembly 30 could be replaced by an alternative type of conductor attachment mechanism.

Figure 2:
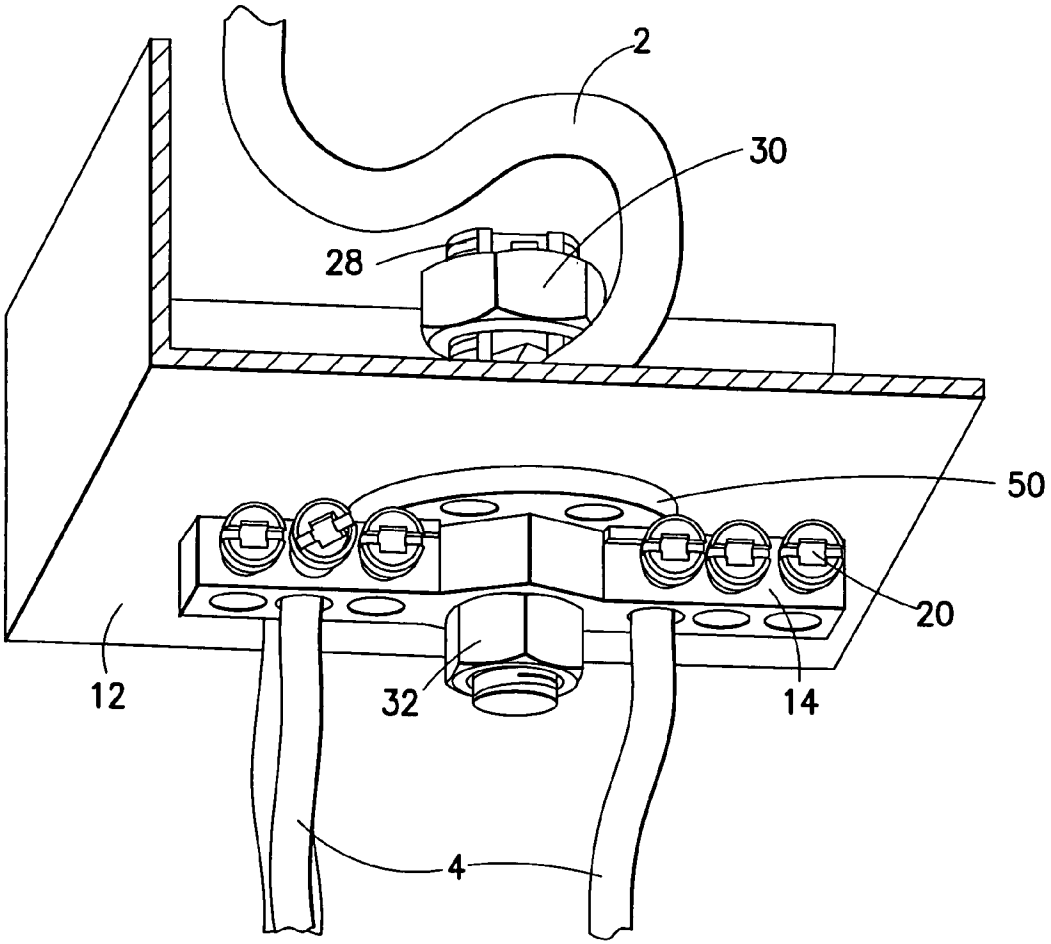
FIG. 2 is a perspective view of the connector assembly and structure shown in FIG. 1.
Figure 3:
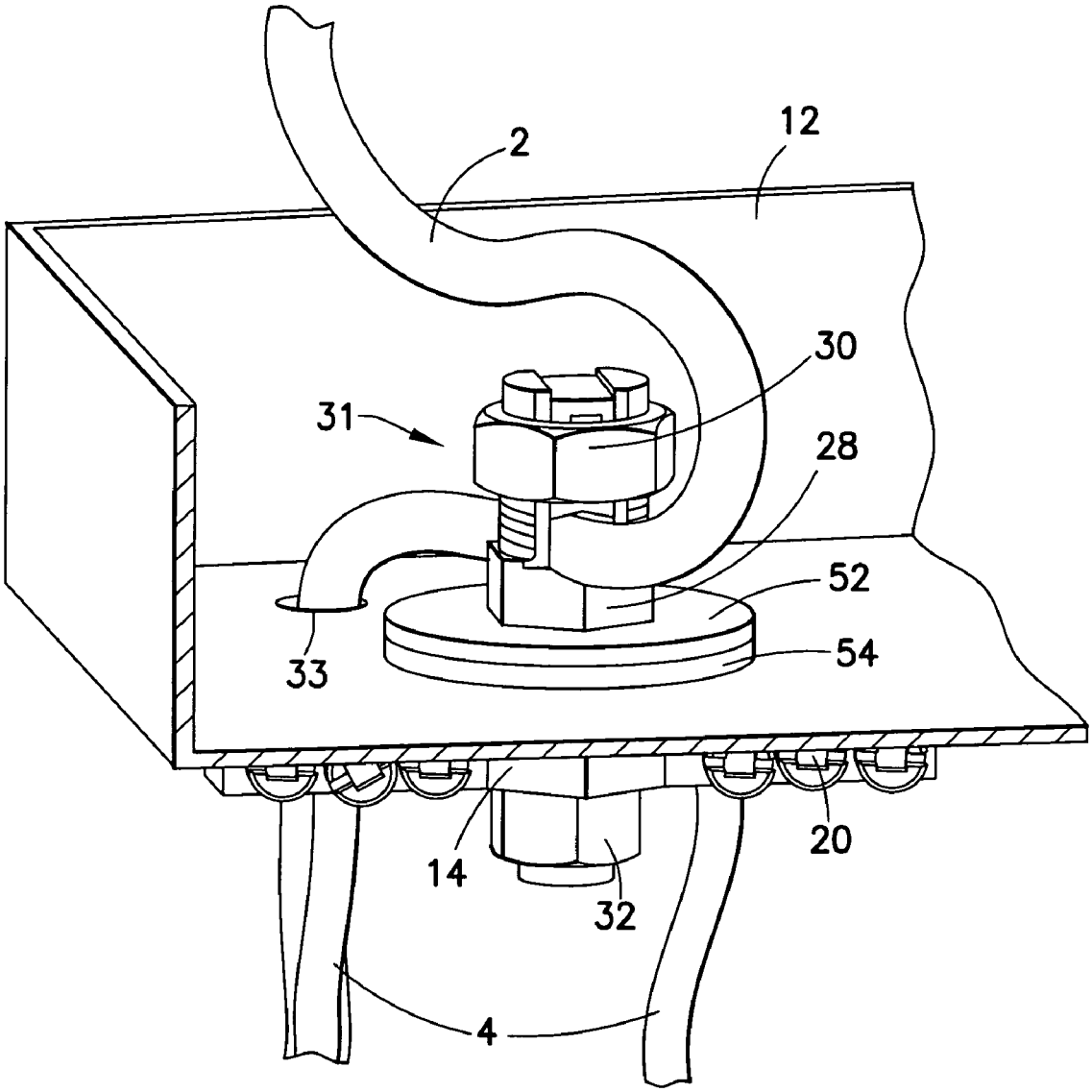
FIG. 3 is a perspective view of the connector assembly and structure shown in FIG. 1 from a different angle.
Figure 4:
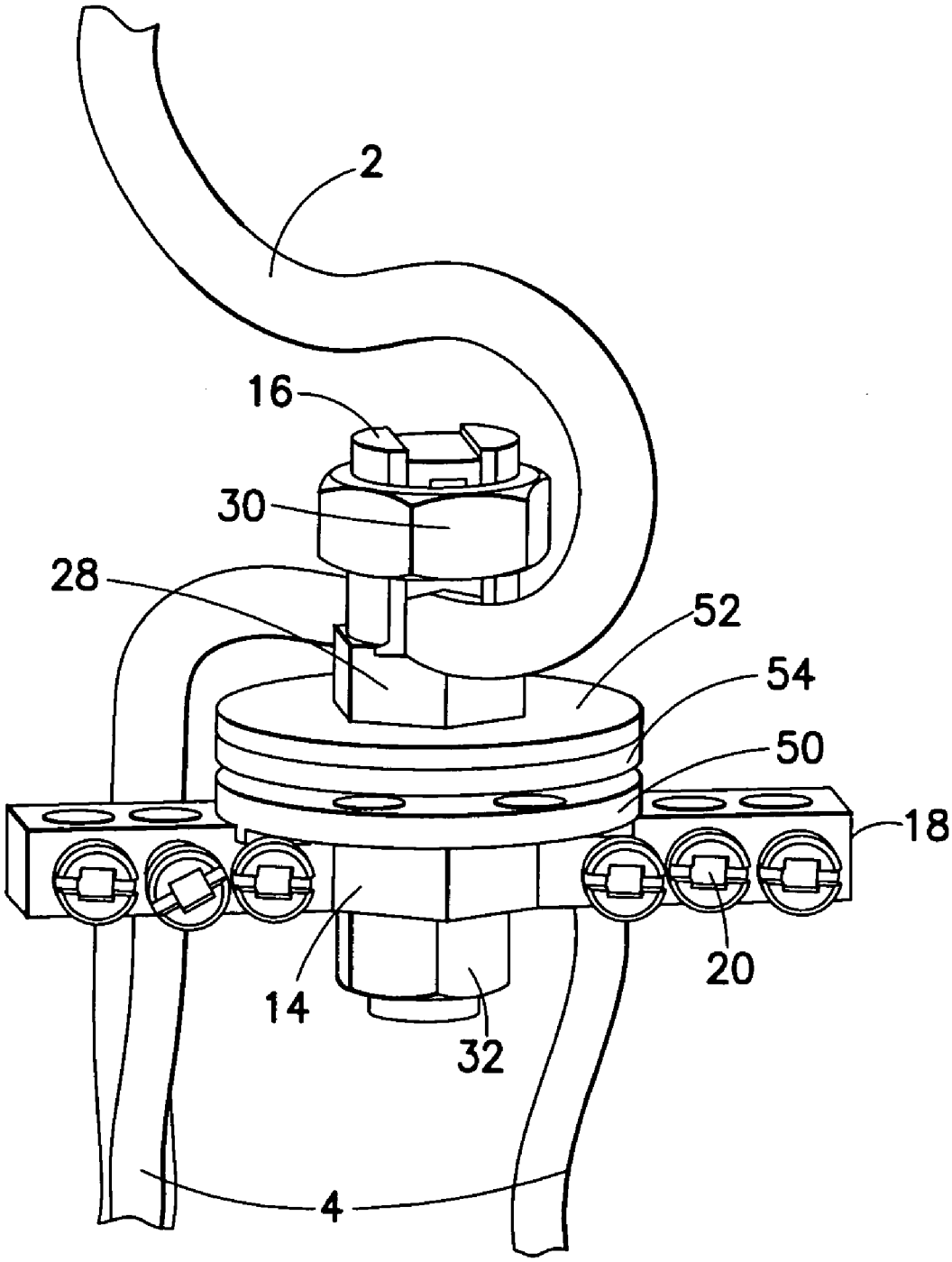
FIG. 4 is a perspective view of the connector assembly shown in FIG. 2 without showing the structure.

In this embodiment the assembly 10 also comprises a plate 50, a washer 52, and a gasket or seal 54. Referring also to FIGS. 2-4, the structure 12 has a hole 56, such as a knock-out hole for example. The plate 50 is preferably comprised of metal or plastic and comprises a center through hole 60 and fastener holes 62. A side of the plate 50 also has key sections 64 to interlock with the frame 18 of the bus bar to prevent rotation of the bus bar frame 18 relative to the plate 50.

The assembly 10 is connected to the structure 12 with the post connector 28 extending through the hole 56. More specifically, the plate 50 is located at an exterior side of the structure 12, and the washer 52 and seal 54 are located at the interior side of the structure 12. The post connector 28 extends through holes in the plate 50, washer 52, and seal 54. The second end 40 of the post connector 28 is sized and shaped to pass through the aperture 22 in the bus bar frame 18. With the plate 50 between the bus bar frame 18 and the exterior side of the structure 12, when the fastener 32 is screwed onto the post connector 28, the members 18, 50, 52, 54 are sandwiched together between the fastener 32 and the bottom side of the middle section 58 in a fixed, stationary assembly on the structure 12 at the hole 56.

As shown in the figures, the main ground conductor 2 can be attached to the assembly 10 with the connection at 31 located inside the structure 12. The structure 12 has a hole 33 to allow the conductor 2 to pass out of the structure for connection to the ground outside a house for example. The bus bar 14 can have the intersystem bonding conductors 4 separately connected thereto outside of the structure 12. Thus, the structure 12 does not need to be opened to connect the wires 4 to the conductor 2 and to ground. The assembly 10 also electrically connects the structure 12 to the conductor 2 and, thus, to ground.

Figure 11:
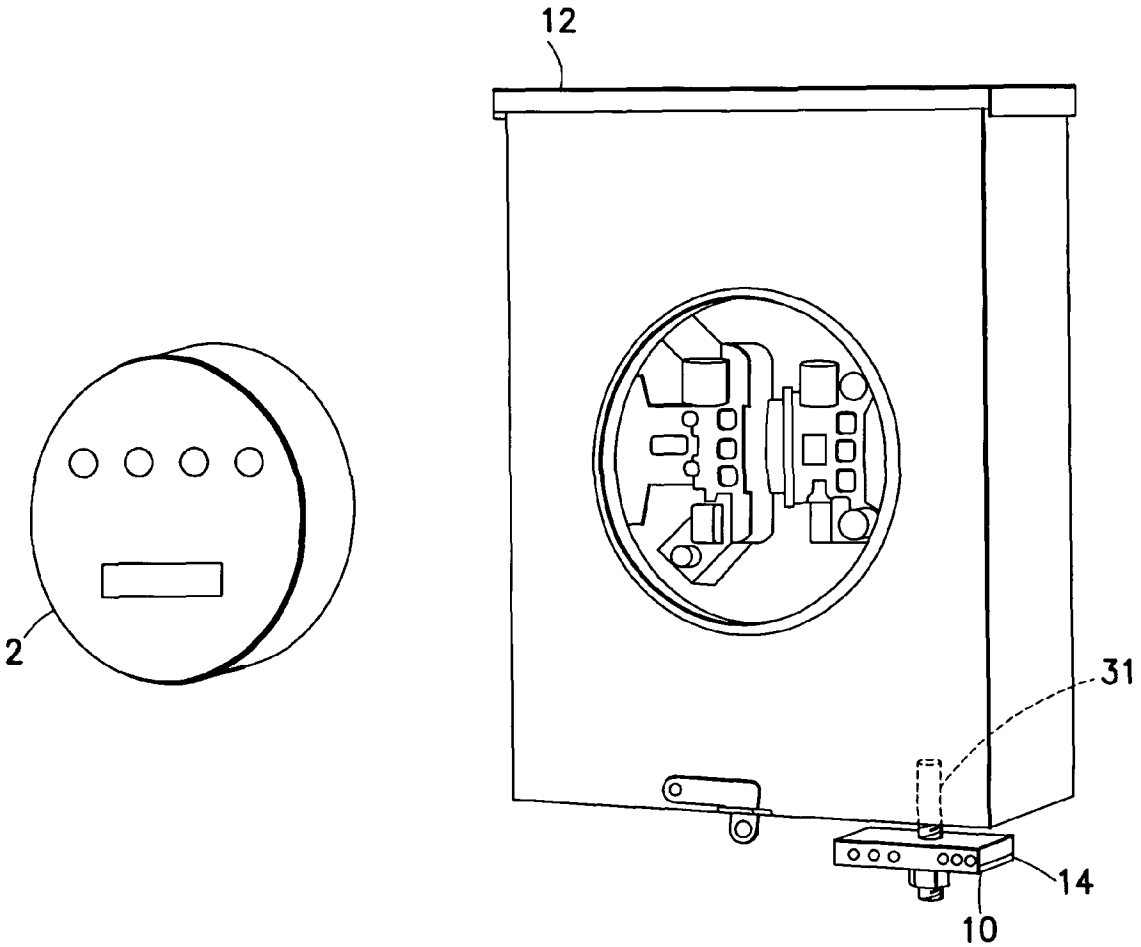
FIG. 11 is a perspective view showing the enclosure as an electrical meter socket.

Referring also to FIG. 11, the enclosure 12 is shown as an electrical meter socket adapted to receive an electrical meter 2. The assembly 10 is connected to the bottom wall of the enclosure 12 with the bus bar 14 located outside the enclosure and the electrical connection section 31 located inside the enclosure. It should be understood that this is merely an example embodiment.

Figure 5:
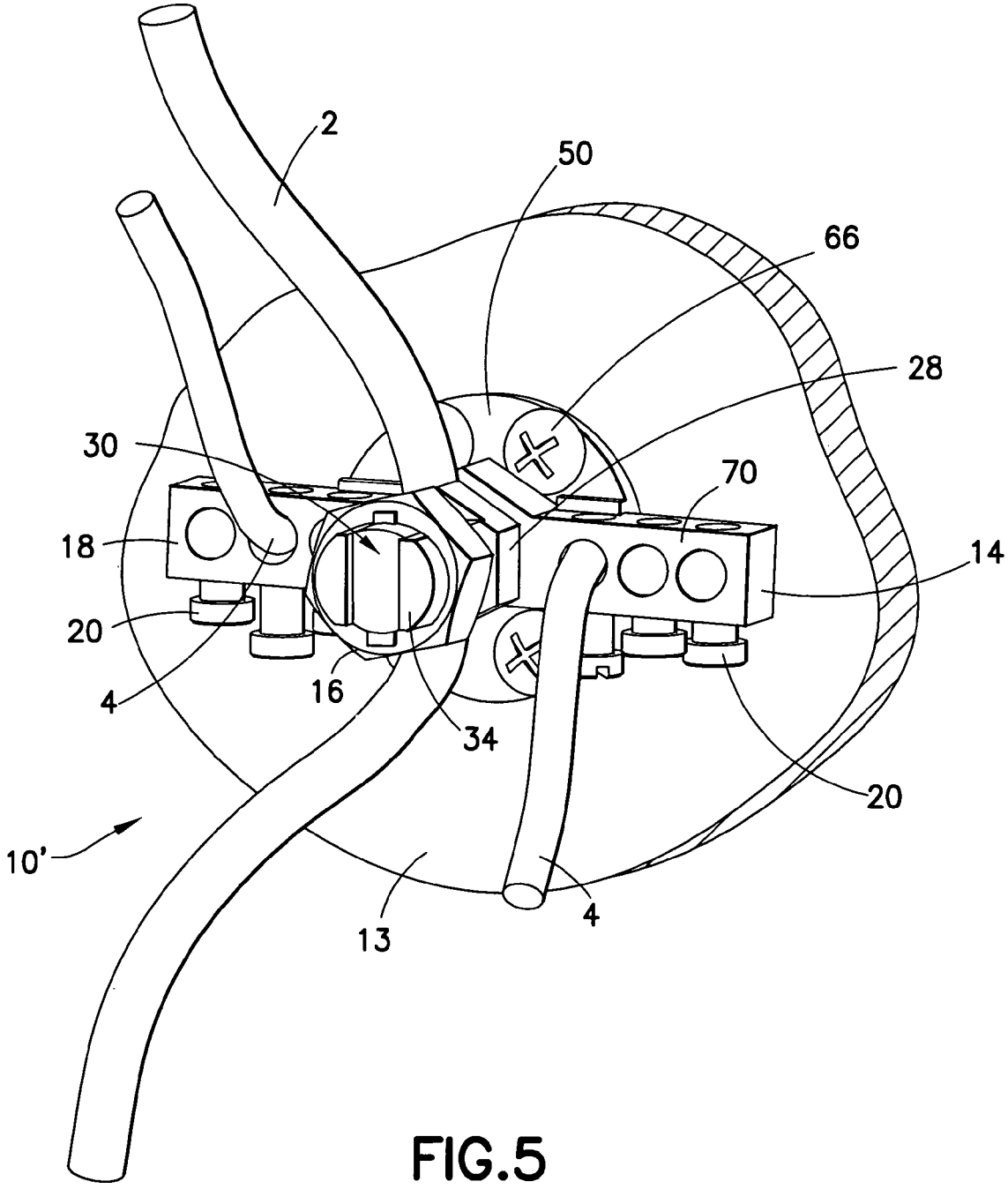
FIG. 5 is a perspective view of the connector assembly shown in FIG. 1 assembled in a second configuration and attached to a different second structure.
Figure 6:
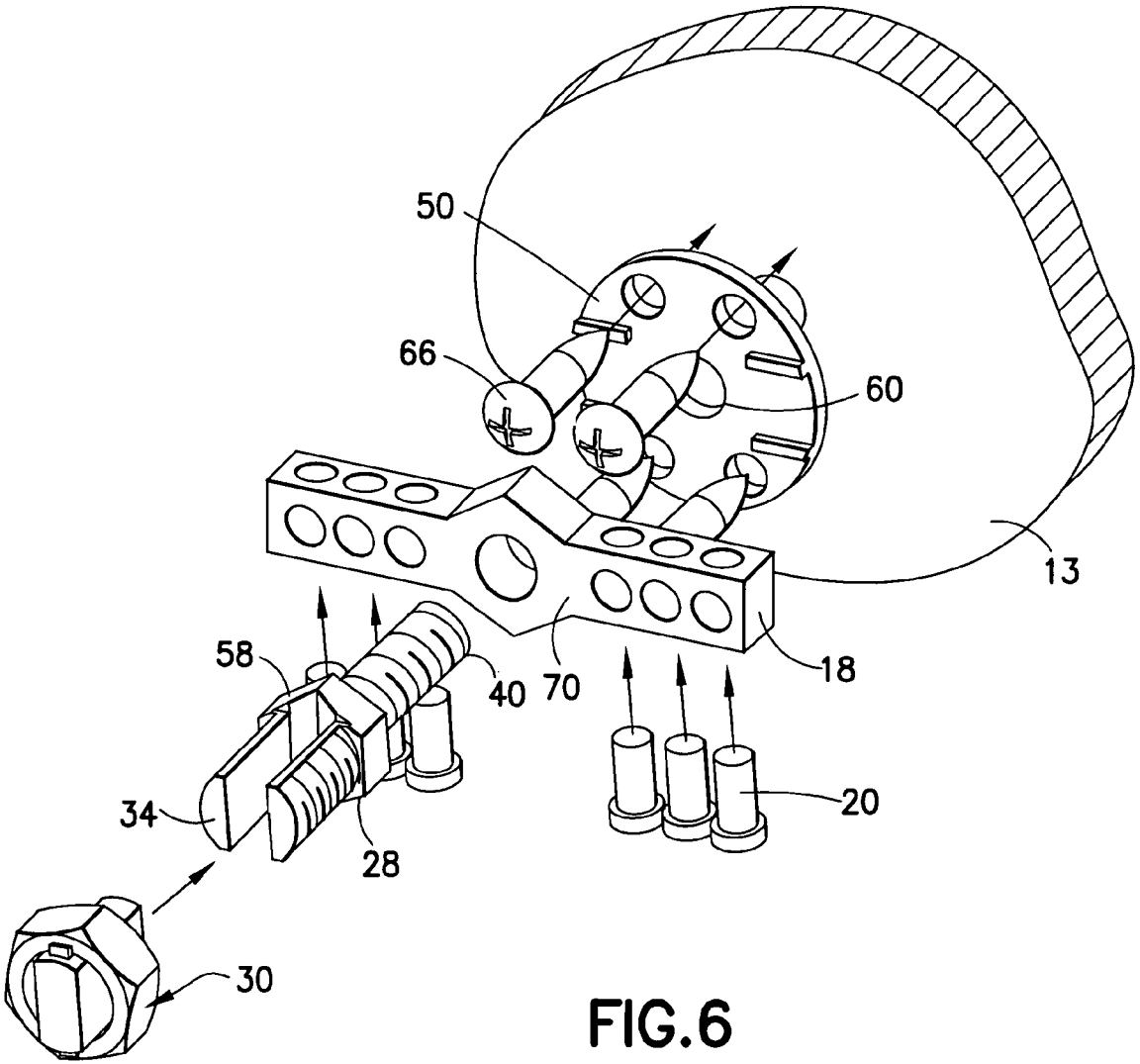
FIG. 6 is an exploded perspective view of the connector assembly as shown in FIG. 5.

Referring also to FIGS. 5-6, the electrical ground connector assembly is shown attached to a second different structure 13; and reconfigured for this purpose. The assembly 10' comprises most of the same components as the assembly 10 and additional fasteners 66, such as screws. The assembly 10' comprises the bus bar 14 and the combined electrical connection and mounting post assembly 16. The bus bar 14 is the same with the frame 18 and the set screws 20. The washer 52 and seal 54 are not needed.

The main difference between the assembly 10 as configured in the first configurations shown in FIGS. 1-4 and the second configuration 10' as shown in FIGS. 5-6 is in regard to the orientation of the post connector 28 relative to the bus bar 14. In the first configuration, the first end 34 is orientated at a first inward facing side 68 of the bus bar frame 18. However, in the second different configuration, the first end 34 is orientated at a second outward facing side 70 of the bus bar frame 18.

In the second configuration, the fastener 32 is located at the inward facing side of the plate 50 such that the frame 18 and plate 50 can be sandwiched between the fastener 32 and the middle section 58. The structure 13 in this example is the exterior side of a house. Thus, the plate 50 can be fixedly, stationarily attached to the exterior side of a house directly by the screws 66. The main ground conductor 2 can be attached to the assembly 16 by the pressure assembly 30. The intersystem ground conductors 4 can be separately connected to the bus bar 14 by the set screws 20. In an alternate embodiment, the hole 60 could be threaded to screw onto the threaded second end 40 of the post connector 28. Thus, the fastener 32 might not be needed in this second configuration.

One embodiment of the invention can provide a dual function grounding and bonding connector device. The first function allows the connector to become an interface between the ground wire on the inside of a metal electrical enclosure and the intersystem ground wires on the outside of the enclosure. The second function allows the same device to be alternatively mounted directly to a structure, such as a wall of a residential building for example, and allows a connection between the ground electrode connector and intersystem ground wires. The embodiment can be designed to also meet the requirements of 2008 NEC article 250.94.

In a first configuration, as shown in FIGS. 1-4, the assembly 16 is assembled with its electrical connection section 31 on one side of the metal case 12 and the bus bar/terminal block 18 on the other side of the metal case 12. The same connector can be alternatively assembled and used in a second configuration shown in FIGS. 5-6. In the second configuration, fasteners 66 are added to secure the plate 50 as a wall mount bracket to the structure 13. The assembly 16 and bus bar 14 are located both on the same side of the wall 13. The washer 52 and the gasket 54 shown in FIGS. 1-4 are not used. Broadly, the connector can be assembled in multiple configurations for more than one application; such as inside/outside the enclosure 12 or wall mounted on wall 13.

Figure 7:
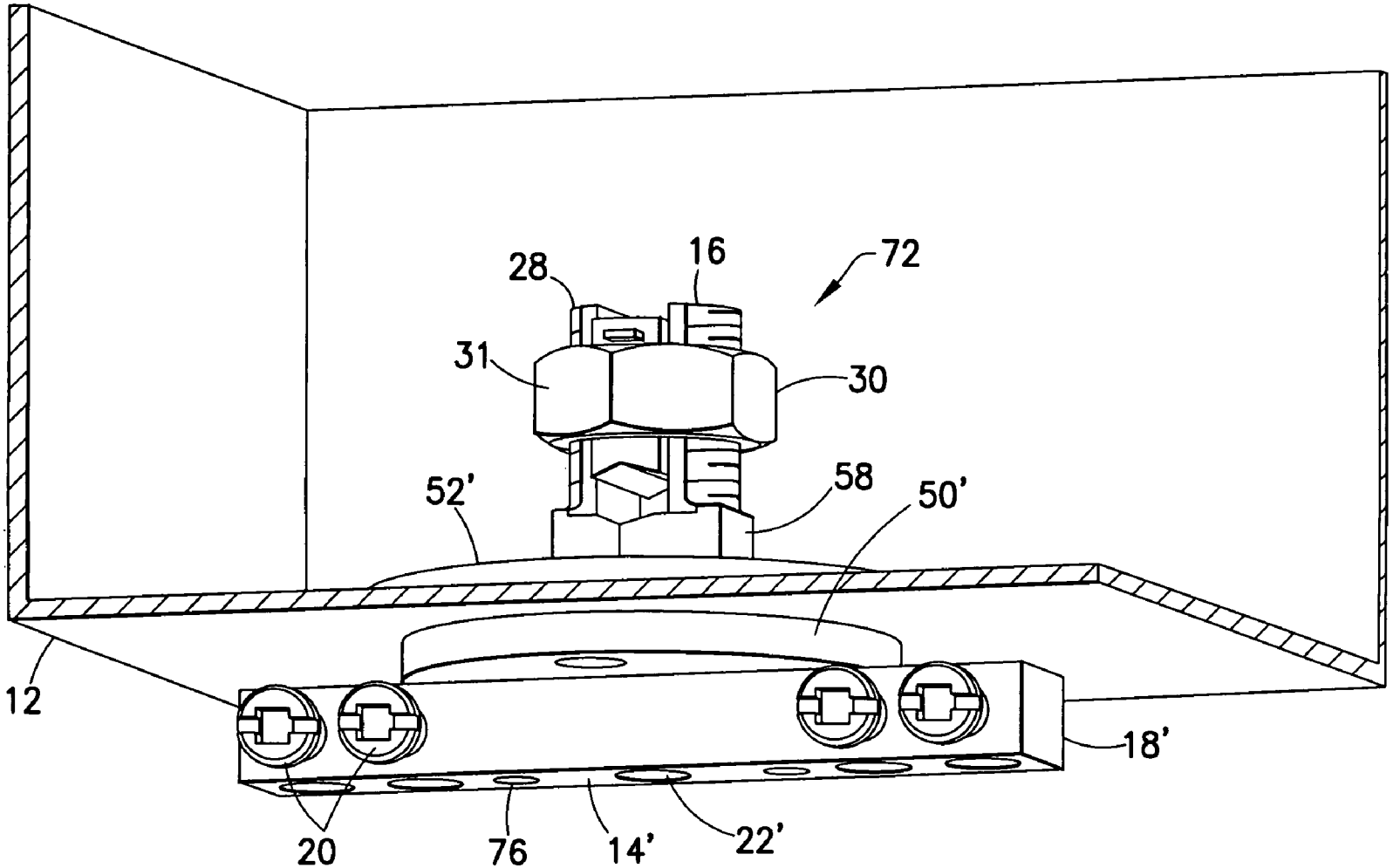
FIG. 7 is a perspective view of an alternate embodiment of the connector assembly shown in FIG. 1 in a first configuration attached to the first structure shown in FIG. 1.
Figure 8:
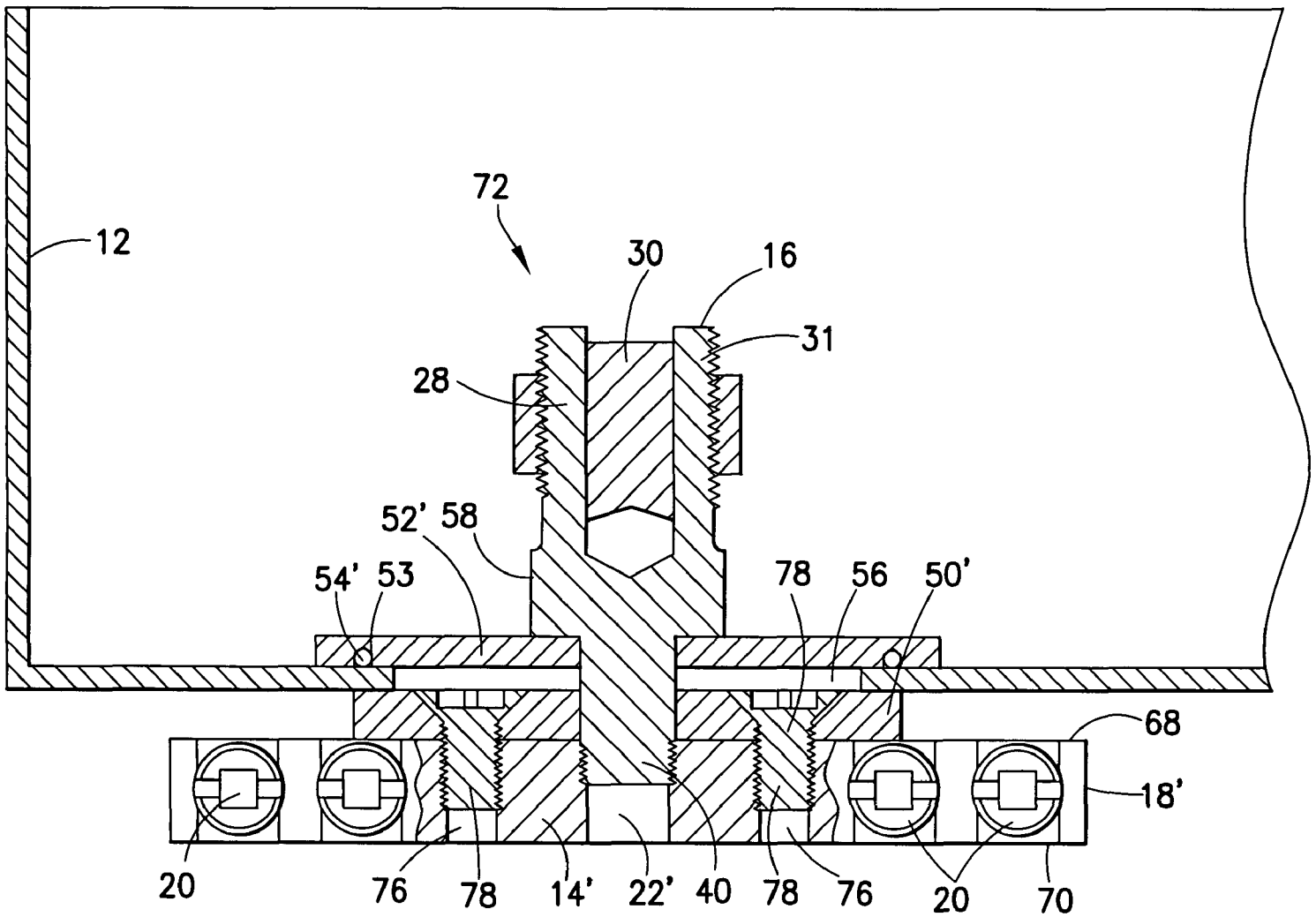
FIG. 8 is a schematic cross sectional view of the connector assembly shown in FIG. 7 attached to the structure.

Referring also to FIGS. 7-8, an alternate embodiment of the invention is shown. The frame 18' of the bus bar 14' is identical to the frame 18 except that it has threaded fastener holes 76 which receive screws 78. This stationarily attaches the frame 18' to the plate 50'. The center aperture 22' of the frame 18' is threaded. The connector post 28 is screwed into the aperture 22' to attach the two members 16, 18' together. The second end 40 could also be screwed into the hole 60' if the hole 60' is threaded. In this embodiment the washer 52' has a seal groove 53. The gasket 54' is an O-ring located in the groove 53.

Similar to the embodiment shown in FIGS. 1-4, the assembly 72 is connected to the structure 12 with the post connector 28 extending through the hole 56 of the structure 12. More specifically, the plate 50' is located at an exterior side of the structure 12, and the washer 52' and seal 54' are located at the interior side of the structure 12. The post connector 28 extends through holes in the plate 50', washer 52', and seal 54'. With the plate 50' between the bus bar frame 18' and the exterior side of the structure 12, when the second end 40 of the post connector 28 is screwed into the hole 22', the members 18', 50', 52', 54' are sandwiched together between the frame 18' and the bottom side of the middle section 58 in a fixed, stationary assembly on the structure 12 at the hole 56. The connection section 31 of the assembly 16 having the pressure assembly 30 is orientated at the inward facing side 68 of the bus bar 14', but inside the metal enclosure 12.

The main ground conductor 2 can be attached to the assembly 72 with the connection located inside the structure 12. The bus bar 14' can have the intersystem bonding conductors 4 separately connected thereto outside of the structure 12. Thus, the structure 12 does not need to be opened to connect the wire 4 to the conductor 2 and to ground. The assembly 72 also electrically connects the structure 12 to the conductor 2 and, thus, to ground.

Figure 9:
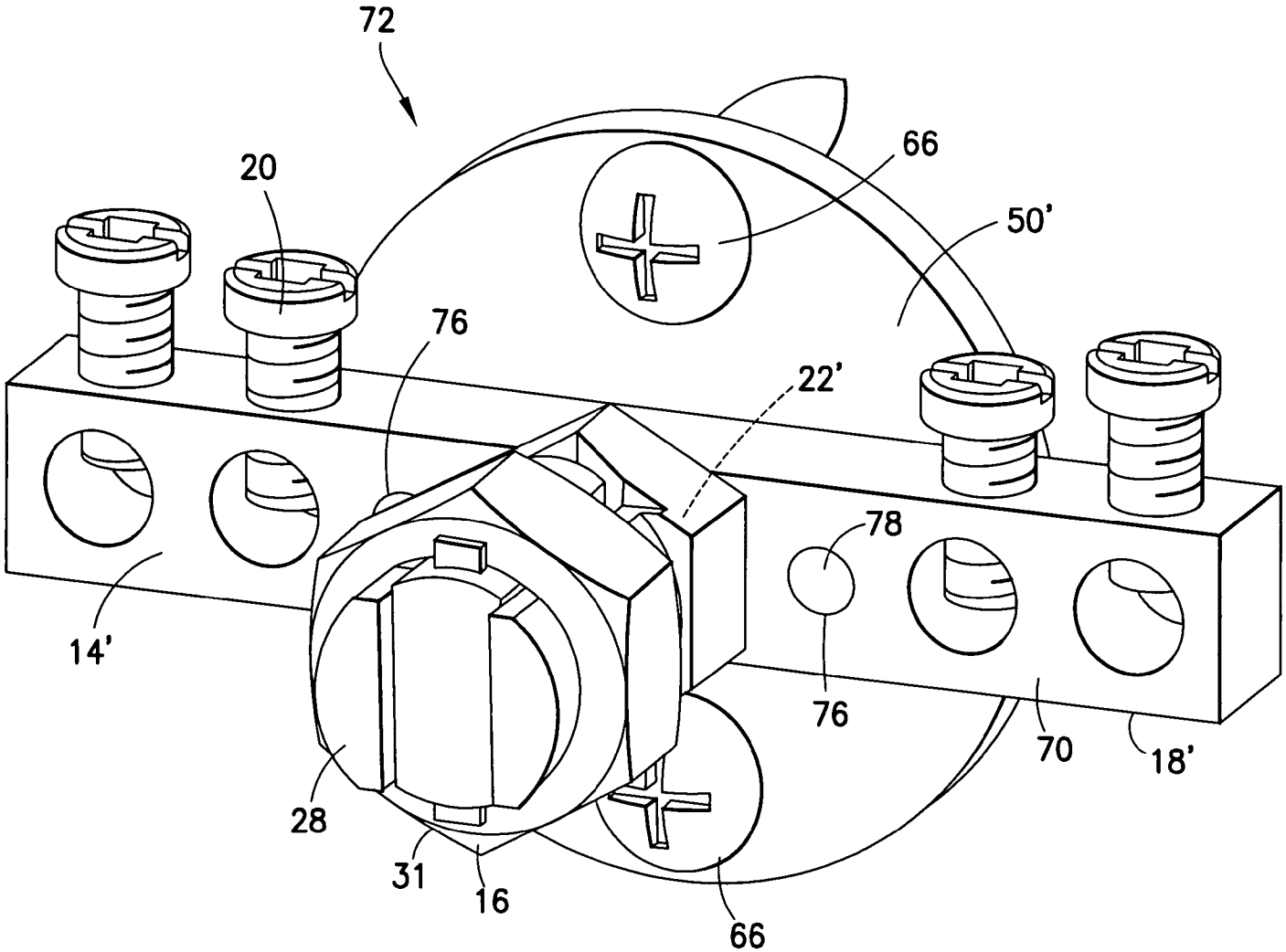
FIG. 9 is a perspective view of the connector assembly shown in FIGS. 7-8 in a second configuration.
Figure 10:
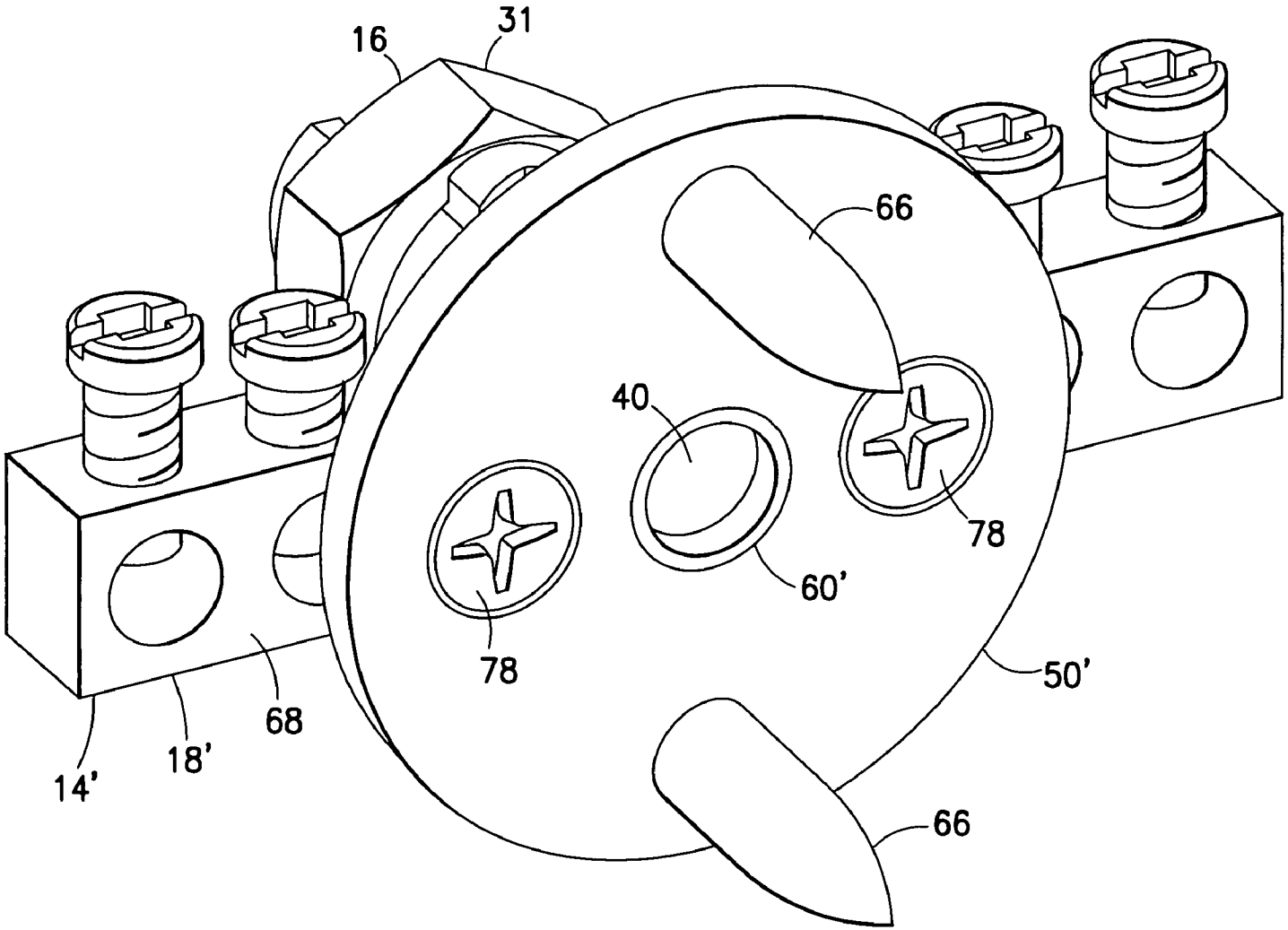
FIG. 10 is a perspective view of the connector assembly shown in FIG. 9 from a rear direction.

Referring also to FIGS. 9-10, the connector assembly 72 is shown reconfigured into a second configuration for attachment to a second different structure, such as the wall 13. The washer 52' and seal 54' are not used in this configuration, but the screws 66 are used. The connection section 31 of the assembly 16 having the pressure assembly 30 is located at the exterior facing side 70 of the bus bar 14'.

As seen in FIG. 10, this embodiment would allow the inward facing side of the plate 74 to be flush mounted to the wall 13 (see FIG. 5) without having to have a hole in the wall 13 for the nut 32 or second end 40. A kit could be provided with both frames 18 and 18'. The installer could then select which frame to use based upon the desired configuration of the connector assembly and the intended structure the connector assembly is intended to be mounted to.

In a first configuration, as shown in FIGS. 7-8, the assembly 16 is assembled with its electrical connection section 31 on one side of the metal case 12 and the bus bar/terminal block 18' on the other side of the metal case 12. The same connector assembly can be assembled differently and used in a second configuration shown in FIGS. 9-10. In the second configuration, fasteners 66 are used to secure the plate 50' as a wall mount bracket to the structure 13. In this second configuration, the assembly 16 and bus bar 14' can be located both on the same side of the wall 13. The washer 52' and the gasket 54' shown in FIGS. 7-8 need not be used in this second configuration. Broadly, the connector assembly 72 can be assembled in multiple configurations for more than one application; such as inside/outside the enclosure 12 or wall mounted on wall 13.

With the alternative or multi-configuration capability of the connector assembly, an installer in the field can use the connector assembly to attach to different structures, in different modes of connection, and in different configurations of assembly based upon the desired mode of connection and/or structure being connected to.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. An electrical ground connector assembly comprising:

a bus bar adapted to have a plurality of electrical wires separately connected thereto;

a combined electrical connection and mounting post assembly directly connected to the bus bar, wherein the combined electrical connection and mounting post assembly is adapted to directly connect an electrical conductor thereto, wherein the combined electrical connection and mounting post assembly extends from the bus bar in a generally cantilever fashion and is configured to supportingly attach the bus bar to a structure; and a plate located directly against one side of the bus bar, wherein the plate comprises a hole with a post of the combined electrical connection and mounting post assembly extending through the hole.

2. An electrical ground connector assembly as in claim 1 wherein the bus bar comprises a middle aperture and wire receiving holes on opposite sides of the middle aperture.

3. An electrical ground connector assembly as in claim 2 wherein the bus bar comprises set screws extending into the holes.

4. An electrical ground connector assembly as in claim 1 wherein the combined electrical connection and mounting post assembly comprises a post and a pressure assembly connected to the post, wherein the post comprises a first end having an electrical conductor receiving channel, wherein the pressure assembly comprises a pressure bar connected to a threaded nut, wherein the threaded nut is located on screw threads of the post, and wherein the pressure bar is located in the electrical conductor receiving channel.

5. An electrical ground connector assembly as in claim 4 wherein a fastener is connected to a second end of the post to retain the bus bar on the post at the second end.

6. An electrical ground connector assembly as in claim 1 further comprising a gasket and a washer, wherein a post of the combined electrical connection and mounting post assembly extends through the gasket and the washer.

7. An electrical ground connector assembly as in claim 1 wherein the plate comprises holes adapted to receive fasteners to directly attach the plate to the structure.

8. An electrical ground connector assembly as in claim 1 wherein an end of a post of the combined electrical connection and mounting post assembly is directly stationarily connected to the plate by a threaded connection.

9. An electrical ground connector assembly as in claim 1 further comprising fasteners directly stationarily attaching the plate to the bus bar.

10. An electrical ground connector assembly as in claim 1 wherein the bus bar and the combined electrical connection and mounting post assembly are adapted to be reconfigured relative to each other into at least two different configurations of the electrical ground connector assembly.

11. An electrical ground connector assembly as in claim 10 further comprising a system for connecting the electrical ground connector assembly to at least two different types of structures, wherein in a first one of the configurations a portion of the post assembly is adapted to extend through a hole in a first one of the structures, and wherein in a second one of the configurations the post assembly and the bus bar are configured to be substantially entirely located outside a second one of the structures at an exterior side of the second structure.

12. An electrical ground connector assembly as in claim 1 further comprising a system for connecting the electrical ground connector assembly to at least two different types of structures, wherein:

the post assembly is adapted to connect to the electrical conductor inside the structure with the bus bar located outside the structure, and the post assembly is adapted to alternatively connect to the electrical conductor outside the structure with the bus bar located outside the structure.

13. An apparatus comprising:

a metal enclosure configured to have an electrical meter connected thereto; and an electrical ground connector assembly as in claim 1 mounted to the metal enclosure, wherein the combined electrical connection and mounting post assembly comprises a connection section located inside the metal enclosure which is adapted to have the electrical conductor directly attach thereto inside the metal enclosure, and the bus bar is located outside of the metal enclosure.

14. An electrical ground connector assembly comprising:

an electrical connection section comprising:

a bus bar adapted to have a plurality of electrical wires separately connected thereto; and a post connector directly connected to the bus bar, wherein the post connector is adapted to physically support the bus bar on a structure, wherein the bus bar and post connector are adapted to be reconfigured relative to each other into at least two different configurations of the electrical ground connector assembly; and a system for connecting the electrical ground connector assembly to at least two different types of structures, wherein in a first one of the configurations a portion of the post connector is adapted to extend through a hole in a first one of the structures, and wherein in a second one of the configurations the post connector and the bus bar are configured to be substantially entirely located outside a second one of the structures at an exterior side of the second structure.

15. An electrical ground connector assembly as in claim 14 the system for connecting comprises a plate located directly against one side of the bus bar, wherein the plate comprises a hole with the post connector extending through the hole.

16. An electrical ground connector assembly as in claim 15 further comprising a gasket and a washer, wherein the post connector extends through the gasket and the washer.

17. An electrical ground connector assembly as in claim 15 wherein the plate comprises holes adapted to receive fasteners to directly attach the plate to the second structure.

18. An electrical ground connector assembly as in claim 15 wherein an end of the post connector is directly stationarily connected to the plate by a threaded connection.

19. An electrical ground connector assembly as in claim 15 further comprising fasteners directly stationarily attaching the plate to the bus bar.

20. An electrical ground connector assembly as in claim 14 wherein the bus bar comprises a middle aperture and wire receiving holes on opposite sides of the middle aperture.

21. An electrical ground connector assembly as in claim 20 wherein the post connector is connected to the middle aperture, and wherein the electrical ground connector assembly further comprises a pressure assembly connected to the post connector, wherein the post connector comprises a first end having an electrical conductor receiving channel, wherein the pressure assembly comprises a pressure bar connected to a threaded nut, wherein the threaded nut is located on screw threads of the post connector, and wherein the pressure bar is located in the electrical conductor receiving channel.

22. An electrical ground connector assembly as in claim 21 wherein a fastener is connected to a second end of the post connector to retain the bus bar on the post connector at the second end.

23. An electrical ground connector assembly as in claim 14 wherein the post connector comprises an electrical conductor receiving channel at a first end, and wherein in the first configuration the first end of the post connector is located at a first side of the bus bar and in the second configuration the first end of the post connector is located at a second opposite side of the bus bar.

24. An electrical ground connector assembly comprising:

an electrical connection section comprising:

a bus bar adapted to have a plurality of electrical wires separately connected thereto;

a combined electrical connection and mounting post assembly directly connected to the bus bar, wherein the combined electrical connection and mounting post assembly is adapted to directly connect an electrical conductor thereto, and wherein the combined electrical connection and mounting post assembly is adapted to physically support the bus bar on a structure; and a plate located directly against one side of the bus bar, wherein the plate comprises a hole with a post of the combined electrical connection and mounting post assembly extending through the hole; and a system for connecting the electrical ground connector assembly to at least two different types of structures, wherein the combined electrical connection and mounting post assembly is adapted to connect to the electrical conductor inside the structure with the bus bar located outside the structure, and the combined electrical connection and mounting post assembly is adapted to alternatively connect to the electrical conductor outside the structure with the bus bar located outside the structure.

25. A method comprising:

connecting a combined electrical connection and mounting post assembly directly to a bus bar in a first configuration, wherein the bus bar adapted to have a plurality of electrical wires separately connected thereto, wherein the combined electrical connection and mounting post assembly is directly connected to the bus bar with an electrical connection section of the assembly orientated at a first side of the bus bar, and wherein the combined electrical connection and mounting post assembly is adapted to physically support the bus bar on a first structure in a general cantilevered fashion;

alternatively connecting the combined electrical connection and mounting post assembly directly to the bus bar in a second different configuration with the electrical connection section of the assembly orientated at a second different side of the bus bar, wherein the combined electrical connection and mounting post assembly is adapted to physically support the bus bar on a second different structure in a general cantilevered fashion.

26. A method comprising:

providing an electrical bus bar comprising a middle section with a post hole, and wire receiving areas on opposite sides of the post hole;

connecting a mounting post to the bus bar by a connection comprising inserting the mounting post into the post hole through a first side of the bus bar to attach the bus bar to the mounting post in a first configuration; and providing the connection as an alternative connection wherein the mounting post can be inserted into the post hole through a second opposite side of the bus bar to attach the bus bar to the mounting post in a second different configuration, wherein the mounting post is adapted to attach the bus bar on a structure in either the first configuration or the second configuration.

27. An apparatus comprising:

an enclosure forming a socket configured to have an electrical meter connected thereto; and an electrical ground connector assembly mounted to the enclosure, wherein the electrical ground connector assembly comprises:

a bus bar adapted to have a plurality of electrical wires separately connected thereto;

a combined electrical connection and mounting post assembly directly connected to the bus bar, wherein the combined electrical connection and mounting post assembly is adapted to directly connect an electrical conductor thereto; and a plate located directly against one side of the bus bar, wherein the plate comprises a hole with a post of the combined electrical connection and mounting post assembly extending through the hole;

wherein the combined electrical connection and mounting post assembly comprises a connection section located inside the enclosure which is adapted to have the electrical conductor directly attach thereto inside the enclosure, and wherein the bus bar is located outside of the enclosure.

* * * * *